US009538614B2

(12) United States Patent
Dhingra

(10) Patent No.: US 9,538,614 B2
(45) Date of Patent: Jan. 3, 2017

(54) APPARATUSES AND METHODS TO DETECT AND PROVISION FOR LIGHTING INTERFACES

(71) Applicant: Echelon Corporation, San Jose, CA (US)

(72) Inventor: Vijay Dhingra, San Jose, CA (US)

(73) Assignee: Echelon Corporation, Santa Clara, CA (US)

( * ) Notice: Subject to any disclaimer, the term of this patent is extended or adjusted under 35 U.S.C. 154(b) by 4 days.

(21) Appl. No.: 14/588,281

(22) Filed: Dec. 31, 2014

(65) Prior Publication Data

US 2016/0192460 A1 Jun. 30, 2016

(51) Int. Cl.
*H05B 37/02* (2006.01)

(52) U.S. Cl.
CPC ..... *H05B 37/0227* (2013.01); *H05B 37/0209* (2013.01)

(58) Field of Classification Search
CPC .. H05B 33/0227; H05B 33/0815; H05B 37/02
USPC ..... 315/308
See application file for complete search history.

(56) References Cited

U.S. PATENT DOCUMENTS 6,188,181 B1 2/2001 Sinha et al.
8,219,452 B2 * 7/2012 Savilia ..... G06Q 30/02 705/26.1
8,575,846 B2 * 11/2013 Delnoij ..... G01J 1/16 315/152
2011/0140611 A1 6/2011 Elek et al.
2013/0241420 A1 * 9/2013 Bal Zs ..... H05B 37/0227 315/154
2013/0320875 A1 * 12/2013 Saes ..... H05B 33/0818 315/224
2014/0103814 A1 * 4/2014 Both ..... H05B 37/0245 315/153
2015/0237694 A1 * 8/2015 Zudrell-Koch .... H05B 33/0815 315/307

FOREIGN PATENT DOCUMENTS

WO 2013/108175 A1 7/2013

OTHER PUBLICATIONS

Search Report from corresponding EP Patent Application No. 15203255.3, mailed May 27, 2016, 7 pages.

* cited by examiner

*Primary Examiner* — Dylan White
(74) *Attorney, Agent, or Firm* — Nicholson De Vos Webster & Elliott LLP

(57) ABSTRACT

Methods and apparatuses relate to detection and provisioning for lighting interfaces. In one embodiment, a hardware apparatus includes a sensing module to detect a lighting interface from a plurality of lighting interfaces to power a light emitting element, and a dimming module to supply multiple power levels of the lighting interface to the light emitting element. In another embodiment, a hardware apparatus further includes a communication module to provide a signal from a network to the sensing module to detect the lighting interface. A lighting interface may be a digital lighting interface or an analog lighting interface.

21 Claims, 7 Drawing Sheets

APPARATUSES AND METHODS TO DETECT AND PROVISION FOR LIGHTING INTERFACES

FIELD

This disclosure relates to a lighting controller and, more particularly, an embodiment of the disclosure relates to the detection and provisioning for multiple lighting interfaces.

BACKGROUND

An increase in the availability of lighting options has increased the utilization of lighting controllers. Different light emitting elements, e.g., a light emitting diode (LED) or fluorescent light bulb, may use different lighting controllers.

BRIEF DESCRIPTION OF THE DRAWINGS

The present invention is illustrated by way of example, and not by way of limitation, in the figures of the accompanying drawings in which like references indicate similar elements.

DETAILED DESCRIPTION

In the following description, numerous specific details are set forth. However, it is understood that embodiments of the invention may be practiced without these specific details. In other instances, well-known circuits, structures and techniques have not been shown in detail in order not to obscure the understanding of this description. It will be appreciated, however, by one skilled in the art that the invention may be practiced without such specific details. Those of ordinary skill in the art, with the included descriptions, will be able to implement appropriate functionality without undue experimentation.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Different lighting interfaces may be utilized in a lighting system. A lighting interface may refer to a lighting protocol or a lighting control system, e.g., the communication protocol to communicate with a light emitting element. Certain light emitting elements may use a digital lighting interface (for example, a digital serial interface (DSI) or a digitally addressable lighting interface, such as the DALI® protocol in International Electrotechnical Commission's technical standard number 62386 of Nov. 7, 2014), an analog lighting interface (e.g., a 0 or 1 to 10V dimming interface or an off and on interface), or others. In one embodiment, a digitally addressable lighting interface allows for the control of a subset of all light emitting elements, e.g., light emitting element(s) may be addressed simultaneously by broadcast commands from a lighting controller. Usage of multiple lighting controllers for each unique lighting interface may result in increased cost factors and complexity factors (e.g., product manufacturing, product distribution, installation, and maintenance).

Figure 1:
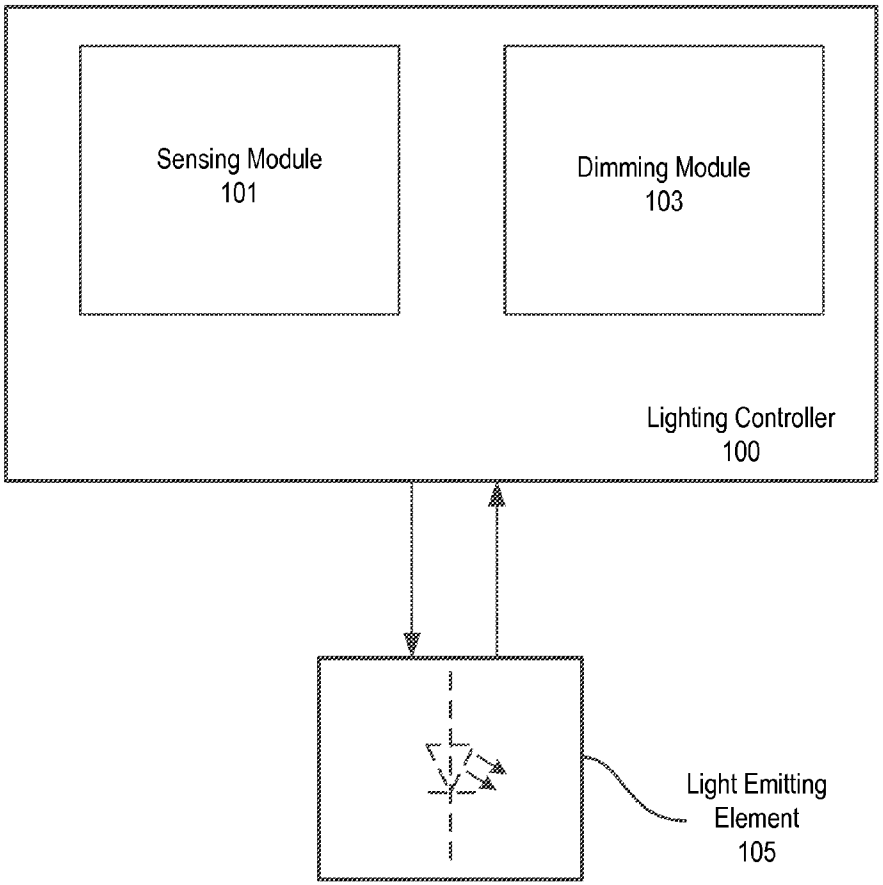
FIG. 1 is a block diagram illustrating an exemplary lighting controller according to an embodiment of the invention.

FIG. 1 illustrates an exemplary lighting controller 100. The lighting controller may include a sensing module 101 and a dimming module 103. The sensing module and the dimming module may be connected to provide the appropriate power (e.g., voltage) levels (e.g., dimming signals) for a light emitting element 105. The dimming module 103 may include circuitry to provide multiple (dimmed) power levels of a lighting interface to the light emitting element 105 (e.g., communicate with the light emitting element to control the light emitting element). A module may include a hardware circuit and/or logic. Dimmed may refer to an emissive visible light output of a light emitting element that is less than its maximum output. In one embodiment, the dimming module 103 includes a digital lighting interface power supply to provide the desired (dimmed) power level to the light emitting element 105. The dimming module may send sets of bits of information (e.g., binary values of "0" or "1") with each set representing a power level (e.g., a dimmed voltage level) to be delivered to a light emitting element 105. Additionally or alternatively, the dimming module 103 may include an analog lighting interface power supply to provide the desired (dimmed) power levels to the light emitting element 105. The light emitting element 105 can include a bulb or lamp (e.g., incandescent, florescent, light-emitting diode (LED), etc.), an individual or part of a group of lighting equipment, such as electronic ballasts and/or illumination sensors, or other lighting technology. In one embodiment, the light emitting element 105 may be a uniquely addressed slave within a digitally addressable lighting interface control circuit. In one embodiment, the lighting controller 100 further includes a processor and/or logic for controlling dimming signals, e.g., controlling the modules. A lighting system may include a non-transitory computer readable medium (e.g., a data storage device) that stores code that when executed by a processor causes the control of a lighting controller according to this disclosure. Although connections (e.g., a wire or other electrically conductive material) are not depicted between modules or between a module(s) and a light emitting element, any connection or connections may be utilized.

While shown as part of the lighting controller 100, each or any module (e.g., sensing module 101, dimming module 103, or other elements) may be separate, for example, as included in a housing unit together with and/or for connection to a light emitting element. In one embodiment, the sensing module 101 detects a lighting interface for the light emitting element 105 by sending a (e.g., initialization) signal to the light emitting element 105. The light emitting element 105 may send a response signal to the sensing module 101, e.g., indicating to the sensing module the appropriate lighting interface for dimming control or indicating that communication therebetween has been established. Each light emitting element of a plurality utilized may send an individual response signal to the sensing module 101, such as a voltage level indicating its appropriate lighting interface (e.g., a response signal of 18V indicating a digital lighting interface). In one embodiment, the lighting controller 100 may detect from the light emitting element 105 a voltage or current level indicating to the lighting controller the power consumed by the light emitting element, e.g., allowing the lighting controller to identify the lighting interface from the power consumption.

In one embodiment, the light emitting element 105 may not send a response signal after a period of time, e.g., indicating to the sensing module 101 that the lighting interface is not a digital lighting interface and is instead an analog lighting interface (e.g., 0-10V lighting interface or a pulse-width modulated (PWM) lighting interface). A light emitting element 105 may send a set of bits to the sensing module, e.g., which the sensing module uses to determine the appropriate lighting interface. Depending on the lighting interface to be utilized by a particular light emitting element (e.g., determined by the sensing module), the dimming module 103 may supply the light emitting element 105 with the appropriate power levels, for example, a dimmed power level corresponding to that particular lighting interface.

Figure 2:
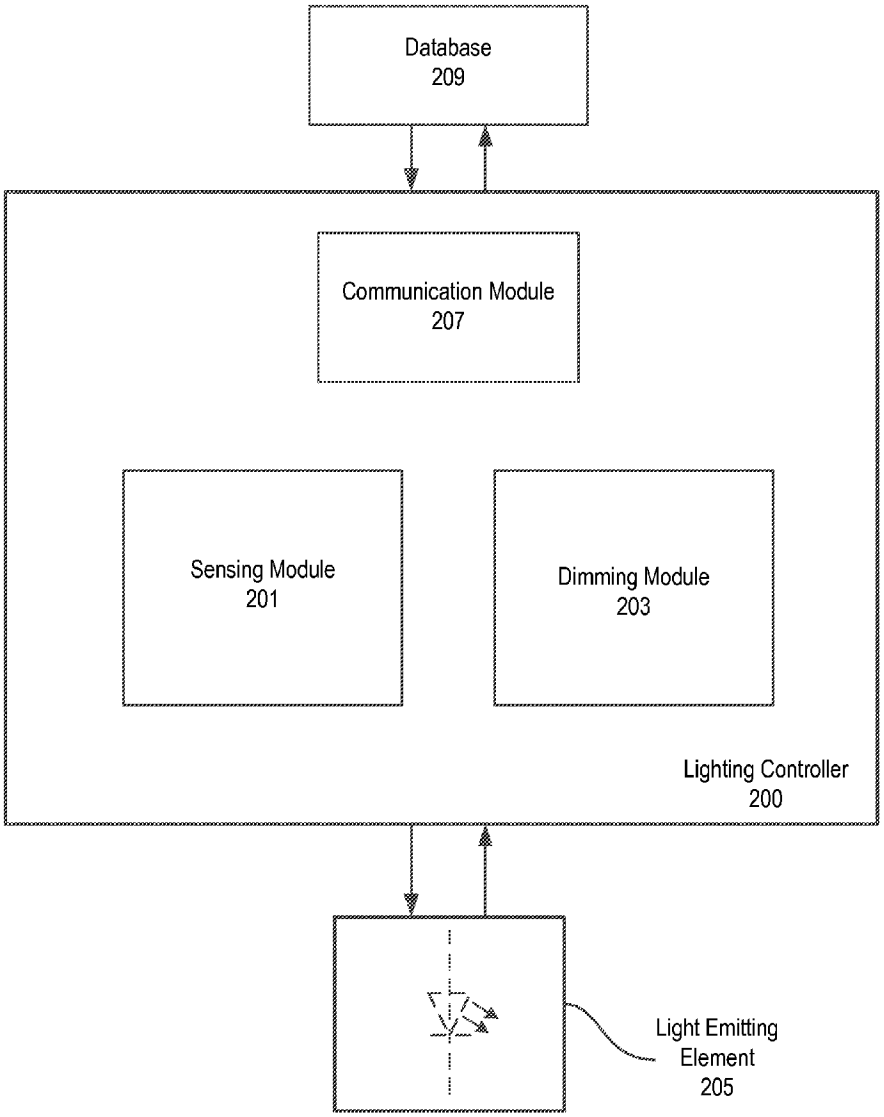
FIG. 2 is a block diagram illustrating an exemplary lighting controller including a communication module according to an embodiment of the invention.

FIG. 2 illustrates an alternative embodiment of a lighting controller 200 that further includes a communication module 207, e.g., for external device communication. The sensing module and the dimming module may be connected to provide the appropriate power (e.g., voltage) levels (e.g., dimming signals) for a light emitting element 205. The dimming module 203 may include circuitry to provide multiple (dimmed) power levels of a lighting interface to the light emitting element 205 (e.g., communicate with the light emitting element to control the light emitting element). Dimmed may refer to an emissive visible light output of a light emitting element that is less than its maximum output. In one embodiment, the dimming module 203 includes a digital lighting interface power supply to provide the desired (dimmed) power level to the light emitting element 205. The dimming module may send sets of bits of information (e.g., binary values of "0" or "1") with each set representing a power level (e.g., a dimmed voltage level) to be delivered to a light emitting element 205. Additionally or alternatively, the dimming module 203 may include an analog lighting interface power supply to provide the desired (dimmed) power levels to the light emitting element 205. The light emitting element 205 can include a bulb or lamp (e.g., incandescent, florescent, light-emitting diode (LED), etc.), an individual or part of a group of lighting equipment, such as electronic ballasts and/or illumination sensors, or other lighting technology. In one embodiment, the light emitting element 205 may be a uniquely addressed slave within a digitally addressable lighting interface control circuit. In one embodiment, the lighting controller 200 further includes a processor and/or logic for controlling dimming signals, e.g., controlling the modules. A lighting system may include a non-transitory computer readable medium (e.g., a data storage device) that stores code that when executed by a processor causes the control of a lighting controller according to this disclosure. Although connections (e.g., a wire or other electrically conductive material) are not depicted between modules or between a module(s) and a light emitting element, any connection or connections may be utilized.

While shown as part of the lighting controller 200, each or any module (e.g., sensing module 201, dimming module 203, communication module 207, or other elements) may be separate, for example, as included in a housing unit together with and/or for connection to a light emitting element. In one embodiment, the sensing module 201 detects a lighting interface for the light emitting element 205 by sending a (e.g., initialization) signal to the light emitting element 205. The light emitting element 205 may send a response signal to the sensing module 201, e.g., indicating to the sensing module the appropriate lighting interface for dimming control or indicating that communication therebetween has been established. Each light emitting element of a plurality utilized may send an individual response signal to the sensing module 201, such as a voltage level indicating its appropriate lighting interface (e.g., a response signal of 18V indicating a digital lighting interface). In one embodiment, the lighting controller 200 may detect from the light emitting element 205 a voltage or current level indicating to the lighting controller the power consumed by the light emitting element, e.g., allowing the lighting controller to identify the lighting interface from the power consumption.

In one embodiment, the light emitting element 205 may not send a response signal after a period of time, e.g., indicating to the sensing module 201 that the lighting interface is not a digital lighting interface and is instead an analog lighting interface (e.g., 0-10V lighting interface or a PWM lighting interface). A light emitting element 205 may send a set of bits to the sensing module, e.g., which the sensing module uses to determine the appropriate lighting interface. Depending on the lighting interface to be utilized by a particular light emitting element (e.g., determined by the sensing module), the dimming module 203 may supply the light emitting element 205 with the appropriate power levels, for example, a dimmed power level corresponding to that particular lighting interface.

In one embodiment, the communication module 207 can communicate with an external source, such as database 209. A database may include, for example, information as firmware and/software updates for existing firmware and/or software on a lighting controller, information as new software for a lighting controller that detects a new/unknown lighting interface, and/or information as a new or refined function that a lighting controller may perform (e.g., relating to a lighting interface). In one embodiment, the sensing module 201 receives a signal (e.g., from the light emitting element 205) indicating that a present lighting interface is new and/or unknown to the lighting controller 200, after which the communication module 207 may connect to an external source (depicted as database 209) to obtain the according information for the lighting interface, e.g., to allow the lighting controller to control a light emitting element according to that lighting interface. In one embodiment, the communication module 207 communicates wirelessly to an external source, e.g., database 209. Additionally or alternatively, the lighting controller 200 may use the communication module 207 to connect to a network (e.g., the internet) to, for example, check for new software code and/or additional software code updates for a lighting interface and/or for maintenance of the lighting controller 200.

Figure 3:
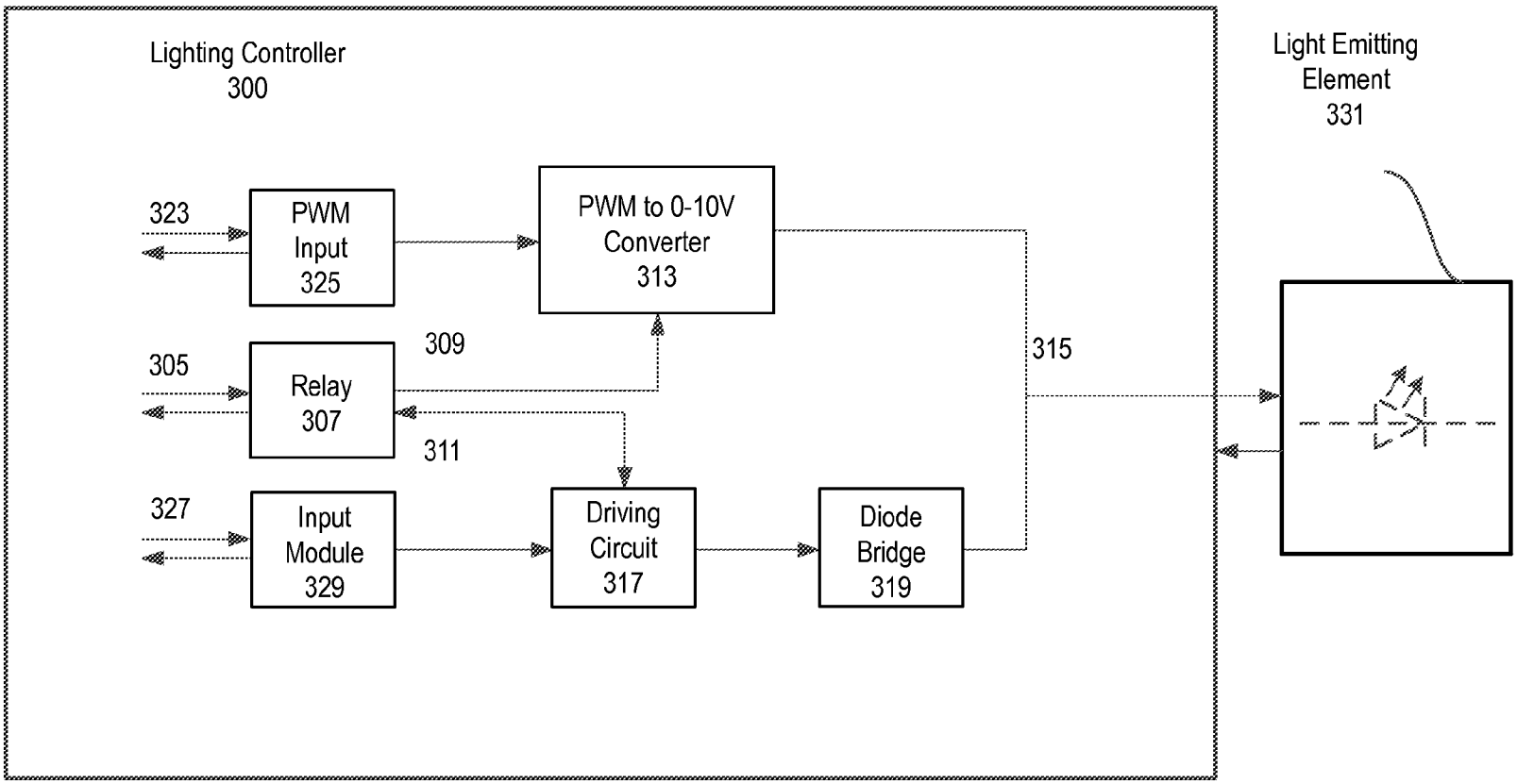
FIG. 3 is a block diagram illustrating an exemplary lighting controller according to an embodiment of the invention.

FIG. 3 illustrates an exemplary lighting controller 300. The lighting controller 300 may include a sensing module and a dimming module. The sensing module and the dimming module may be connected to provide the appropriate dimming power levels (e.g., signals) for a light emitting element 331. In one embodiment, the inputs 323, 305, 327 of the lighting controller 300 may both receive and transmit signals to any of a single or plurality of circuit elements within the lighting controller. In one embodiment, a relay (e.g., relay 307) may receive and transmit signals to a lighting interface (e.g., driving circuit 317) or any element within a plurality of circuit elements of the lighting controller.

In one embodiment, a driving circuit (e.g., a digital lighting interface driver) may be part of a sensing module. When the lighting controller 300 is powered on, (e.g., through a connection to a light emitting element, a signal from a processor or control logic, etc.) the lighting controller 300 may send a signal to a digital lighting interface driving circuit 317. The lighting controller 300 may wait for a response from the driving circuit 317, and if the lighting controller receives a response signal from the driving circuit (e.g., within a time period) indicating that a digital lighting interface is established or to be used, the lighting controller may act as a master (e.g., within a digitally addressable lighting interface) and engage the driving circuit and/or the light emitting element as a slave to provide and/or control dimming signals to the light emitting element. In one embodiment, the dimming module includes an input that may receive digital or analog signals (e.g., pulse-width modulated signals) from the lighting controller 300. In one embodiment, the lighting controller 300 may send a signal to the light emitting element 331 and the light emitting element may send a response signal back to the lighting controller. The driving circuit 317 may send the response signal from the light emitting element 331 to the input 305, for example, controlling the depicted relay 307 to select the appropriate lighting interface to be utilized. This may include selecting either of an analog lighting interface power supply (e.g., converter 313) or a digital lighting interface power supply (e.g., driving circuit 317) to connect to the light emitting element.

In one embodiment, the driving circuit 317 is a digitally addressable lighting interface driver according to the DALI® standard discussed previously. The lighting controller 300 may commission the driving circuit 317 by sending a command signal to the driving circuit and may wait for a response. After a period of time (e.g., a period of 10 seconds) has elapsed, the lighting controller 300 may detect the voltage level between the input of the driving circuit 317 and ground. If the signal detected by the lighting controller 300 from the driving circuit 317 is a high-voltage signal (e.g., a voltage level between 19V and 23V), the digital lighting interface mode may be enabled and the relay 307 may accept a dimming input signal at 305 and route the signal via connection 311 through the portion of the lighting controller 300 that is the digital lighting interface. In one embodiment, the lighting controller 300 includes a diode bridge (e.g., diode bridge 319) allowing the lighting controller to be compatible with both positive and negative dimming control signals that are sent to and/or from the light emitting element 331, the driving circuit 317, and/or the lighting controller. While illustrated separately from the driving circuit 317, a diode bridge may be part of the driving circuit or part of or included in the same housing as another element of the lighting controller 300. In one embodiment, where the lighting controller 300 routes an input signal through a digital lighting interface, the output 315 of the lighting controller may provide the appropriate power level (e.g., dimming signal) to the light emitting element 331.

In one embodiment, if the signal detected by the lighting controller 300 from the driving circuit 317 is not a high-voltage signal (e.g., it is a voltage level between 0V and 10V), this indicates to the lighting controller that the lighting interface is not a digital lighting interface and is instead an analog lighting interface (e.g., a 0-10V dimming interface). The dimming input signal 305 of the lighting controller 300 may be an analog signal (e.g., 0-10V signal) and the relay 307 may route the signal via connection 309 through the portion of the lighting controller that is the analog lighting interface (e.g., 0-10V lighting interface or a PWM lighting interface). The input signal may be routed to the PWM to 0-10V converter 313 to demodulate the input signal into an analog output signal 315 appropriate for an analog lighting interface (e.g., a 0-10V lighting) to provide the appropriate power level (e.g., dimming signal) to the light emitting element 331. In one embodiment, the lighting controller 300 includes an analog input signal 323 and a PWM input module 325 that accepts a pulse-width modulated input signal appropriate for an analog lighting interface (e.g., a 0-10V lighting interface or a PWM lighting interface) without routing the signal through a digital-analog relay (e.g., relay 307). An input signal at 323 may be routed through the PWM to 0-10V converter 313 to demodulate the input signal (e.g., a PWM input signal) into an output signal 315 appropriate for an analog lighting interface (e.g., the 0-10V lighting interface) to provide a desired power level (e.g., dimming signal) to the light emitting element 331. In one embodiment, the lighting controller 300 may receive a pulse-width modulated input signal (e.g., from 323 or 305) and not route the input signal through a PWM to 0-10V converter 313, for example, providing a pulse-width modulated output signal appropriate for a PWM lighting interface (e.g., to a light emitting element without the use of converter 313).

In one embodiment, after detecting the appropriate lighting interface, the lighting controller 300 may receive information from the sensing module, a processor, or other control logic including, for example, a new voltage or current level of the light emitting element or a control signal for a new lighting interface. The lighting controller 300 may compare the received information to the previously detected information (e.g., a detected voltage level used to determine a previous lighting interface) and may or may not update to a new lighting interface (e.g., changing the state of the relay 307) based on the received information. In one embodiment, the lighting controller 300 may detect a digital lighting interface that is new and/or unknown. In such an embodiment, the lighting controller 300 may (e.g., via a connection to an external source) obtain the appropriate software for the lighting interface, and the dimming module may include additional inputs (e.g., input 327), and additional input modules (e.g., input module 329) to accept incoming signals and route the signals in accordance with the appropriate lighting interface to provide desired power level (e.g., dimming signal) to the light emitting element 331.

Figure 4A:
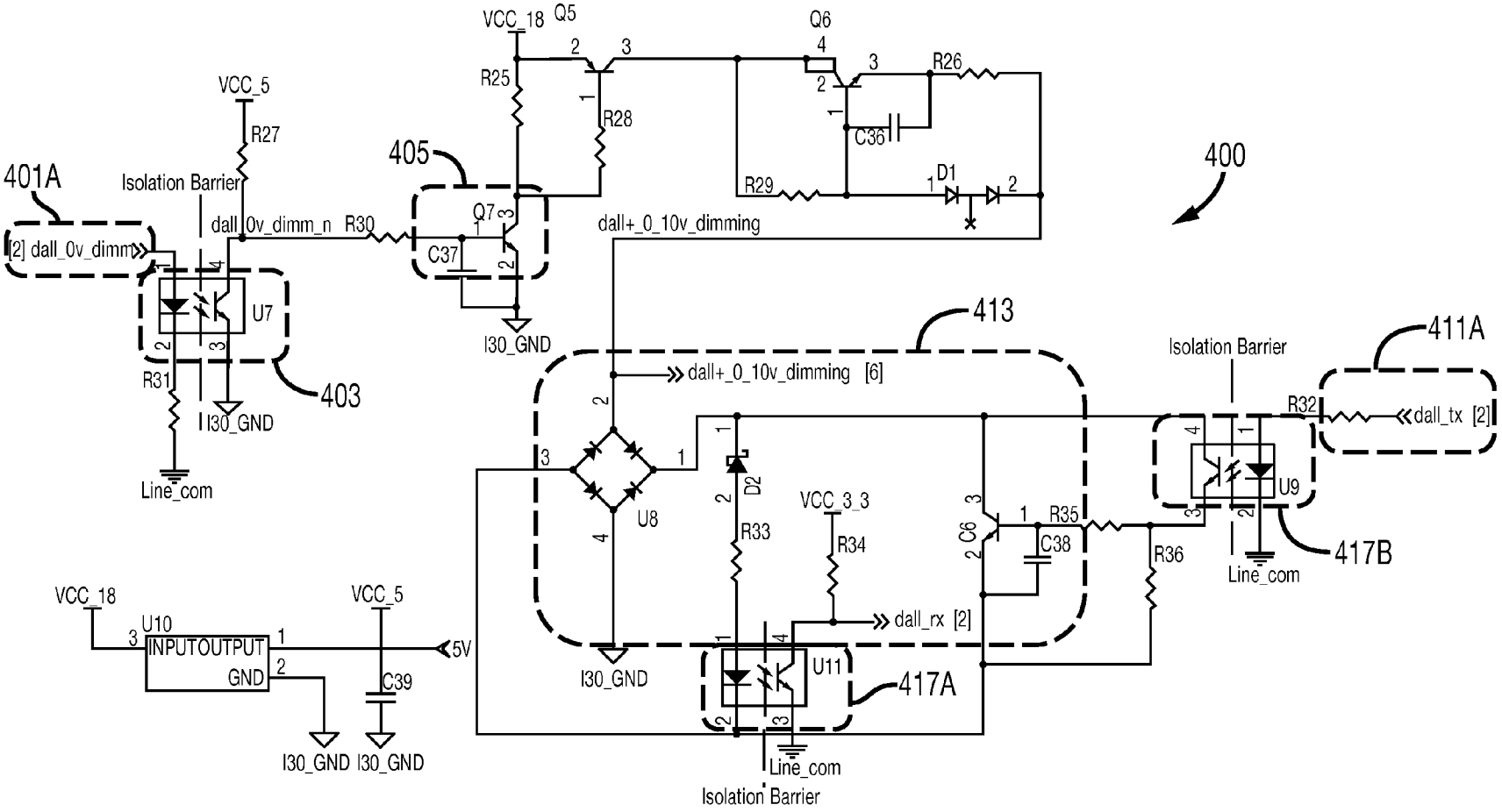
FIGS. 4A and B illustrate an exemplary circuit layout of a dimming module according to an embodiment of the invention.
Figure 4B:
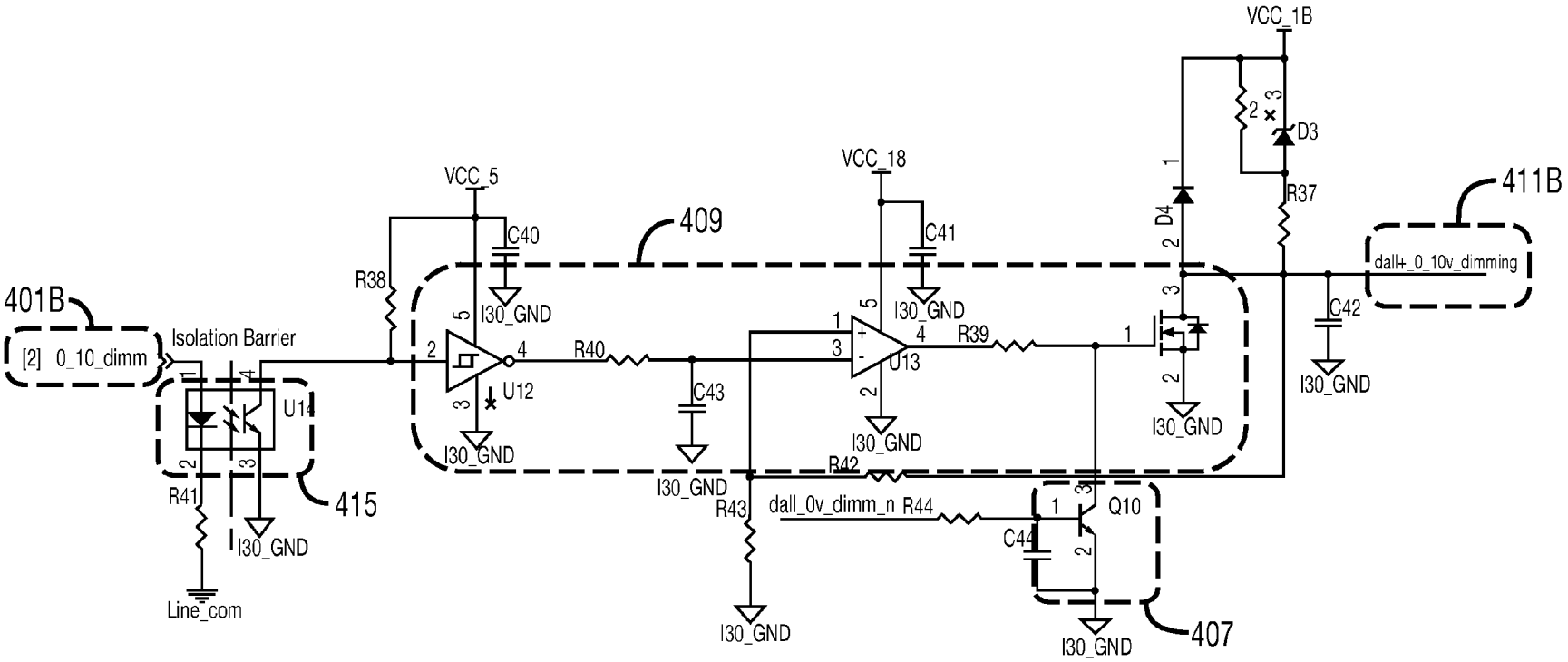

FIGS. 4A and B illustrate an embodiment of an exemplary circuit layout of a lighting controller 400, showing example circuit implementations of the elements from FIG. 3. The circuit elements illustrated in 413 represent an example implementation of the driving circuit 317, for example, a digital lighting interface driver, e.g., according to the DALI® standard. The circuit elements illustrated in 409 represent an example implementation of the PWM to 0-10V converter 313. The circuit elements illustrated in 403 represent an example implementation of the relay 307. The circuit elements illustrated in 401A, 401B, 405, and 407 represent an example implementation of a digital lighting interface dimming input signal (e.g., DALI® dimming input signal), an analog lighting interface dimming input signal (e.g., 0-10V dimming input signal or a PWM dimming input signal), an analog lighting interface dimming signal enable (e.g., 0-10V dimming enable or a PWM dimming enable), and a digital lighting interface dimming signal enable (e.g., DALI® dimming enable), respectively. The circuit elements illustrated in 411A and 411B represent example implementation of a digital lighting interface dimming signal output (e.g., DALI® dimming signal output), and an analog lighting interface dimming signal output (e.g., 0-10V dimming signal output or a PWM dimming signal output), respectively. The circuit elements illustrated in 415, 417A, and 417B represent example implementation of a pulse-width modulated input module for an analog lighting interface (e.g., 0-10V lighting interface or a PWM lighting interface), and alternative input signal modules for new and/or unknown lighting interfaces, respectively.

In one embodiment, the lighting controller 400 commissions the driving circuit 413 by sending a command signal to the driving circuit and may wait for a response. After a period of time (e.g., a period of 10 seconds), the lighting controller 400 detects the voltage level between the input of the driving circuit 413 and ground. If the signal detected by the lighting controller 400 from the driving circuit 413 is a high-voltage signal (e.g., a voltage level between 19V and 23V), the digital lighting interface (e.g., DALI® dimming mode) is enabled 407 and the relay 403 accepts the digital lighting interface dimming signal at 401A and routes the signal through the portion of the lighting controller 400 that is the digital lighting interface (e.g., through the driving circuit 413). In one embodiment, the driving circuit 413 includes a diode bridge (e.g., diode bridge 319) allowing the lighting controller to be compatible with both positive and negative dimming control signals that are sent to and from the light emitting element 331, the driving circuit 413, and/or the lighting controller 400. The diode bridge 319 may be part of the driving circuit 413 or part of or included in the same housing as another element of the lighting controller 400. In one embodiment, where the lighting controller 400 routes an input digital lighting interface dimming signal at 401A through a digital lighting interface (e.g., through the driving circuit 413), the digital lighting interface dimming signal output of the lighting controller 411A will provide the appropriate digital lighting interface dimming signals for the light emitting element 331.

In one embodiment, the signal detected by the lighting controller 400 from the driving circuit 413 is not a high-voltage signal (e.g., a voltage level between 0V and 10V) indicating to the lighting controller that the lighting interface is not a digital lighting interface and is instead an analog lighting interface (e.g., a 0-10V dimming interface or a PWM dimming interface). In such an embodiment, the analog lighting interface (e.g., 0-10V dimming mode) is enabled 405 and the relay 403 accepts the input analog lighting interface dimming signal at 401B and routes the signal through the portion of the lighting controller 400 that is the analog lighting interface (e.g., through the PWM to 0-10V converter 409). The analog lighting interface dimming signal at 401B is routed to the PWM to 0-10V converter 409 to demodulate the input signal (e.g., a PWM input signal) into an analog lighting interface dimming output signal at 411B appropriate for an analog lighting interface (e.g., the 0-10V lighting interface) and to provide an analog lighting interface dimming signal to the light emitting element 331. In one embodiment, the lighting controller 400 includes a PWM input module 415 for an analog lighting interface that accepts an input pulse-width modulated signal at 401B appropriate for an analog lighting interface (e.g., 0-10V lighting interface) without routing the signal through a digital-analog relay (e.g., relay 403). An input analog lighting interface dimming signal at 401B is routed through the PWM to 0-10V converter 409 to demodulate the input signal into an analog lighting interface dimming output signal at 411B appropriate for an analog lighting interface (e.g., the 0-10V lighting interface) and to provide an analog lighting interface dimming signal to the light emitting element 331. In one embodiment, the lighting controller 400 may accept an input pulse-width modulated signal at 401B and not route the input signal through the PWM to 0-10V converter 409, e.g., providing a pulse-width modulated output signal at 411B appropriate for a PWM lighting interface.

In one embodiment, after detecting the appropriate lighting interface, the lighting controller 400 may receive information from the sensing module, a processor, or other control logic including, for example, a new voltage or current level of the light emitting element or a control signal for a new lighting interface. The lighting controller 400 may compare the received information to the previously detected information (e.g., a detected voltage level used to determine a previous lighting interface) and may or may not update to a new lighting interface (e.g., changing the state of the relay 403) based on the received information. In one embodiment, the lighting controller 400 may detect a digital lighting interface that is new and/or unknown. In such an embodiment, the lighting controller 400 may connect to an external source to obtain the appropriate software code for the lighting interface, and the dimming module may include additional inputs (e.g., alternative input signal modules for new and/or unknown lighting interfaces 417A and 417B), and additional input modules (e.g., input module 329) to accept incoming signals and route the signals in accordance with the appropriate lighting interface to provide dimming signals to the light emitting element 331.

Figure 5:
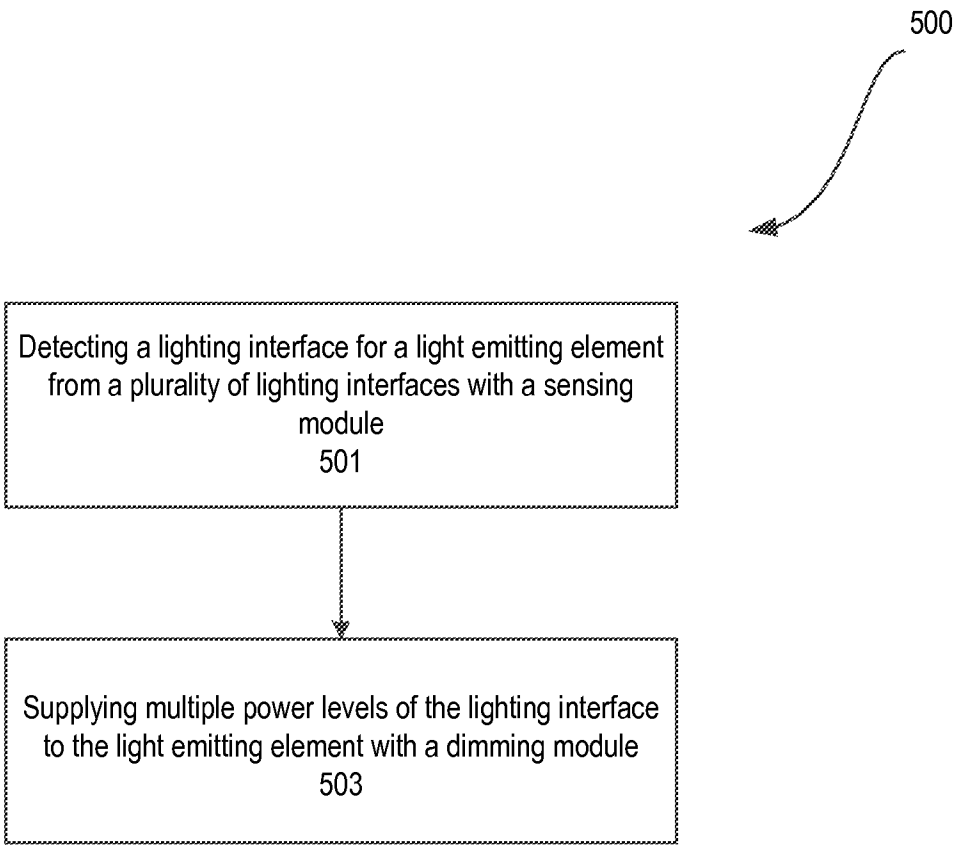
FIG. 5 is a flow diagram of an exemplary method of detecting a lighting interface and supplying the dimming signals for a light emitting element according to an embodiment of the invention.

FIG. 5 is a flow diagram illustrating an exemplary method 500 of detecting a lighting interface and supplying the appropriate power levels (e.g., dimming signals) for a light emitting element, for example, with respect to the embodiments in FIGS. 1 through 3. Method 500 includes detecting a lighting interface with a sensing module from a plurality of lighting interfaces to power a light emitting element 501, and supplying multiple power levels of the lighting interface to the light emitting element with a dimming module 503.

A sensing module (e.g., sensing module 101 or 201) may detect a lighting interface for the light emitting element (e.g., light emitting element 105, 205, or 331) by sending a signal to the light emitting element. The light emitting element may send a response signal to the sensing module, e.g., indicating to the sensing module the appropriate lighting interface for dimming control. The light emitting element may send an individual response signal, such as a voltage level indicating the appropriate lighting interface (e.g., a response signal of 18V indicating a digital lighting interface).

In one embodiment, the lighting controller (e.g., lighting controller 100, 200, or 300) may detect from the light emitting element a voltage or current (e.g., consumption) level indicating to the lighting controller the power consumed by the light emitting element, allowing the lighting controller to identify the lighting interface. The light emitting element may not send a response signal after a period of time, e.g., indicating to the sensing module that the lighting interface is not a digital lighting interface and is instead an analog lighting interface (e.g., 0-10V lighting interface or a PWM lighting interface). The light emitting element may send a set of bits to the sensing module, e.g., which the sensing module uses to determine the appropriate lighting interface. At 503, depending on the lighting interface to be utilized (e.g., by the light emitting element) and information from the sensing module, the dimming module (e.g., dimming module 103 or 203) may supply the light emitting element with the appropriate power levels, for example, the power levels corresponding to a particular lighting interface. In one embodiment, the dimming module may supply digital lighting interface dimming signals to the light emitting element appropriate for a digital lighting interface. In another embodiment, the dimming module may supply analog lighting interface dimming signals to the light emitting element appropriate for an analog lighting interface.

Figure 6:
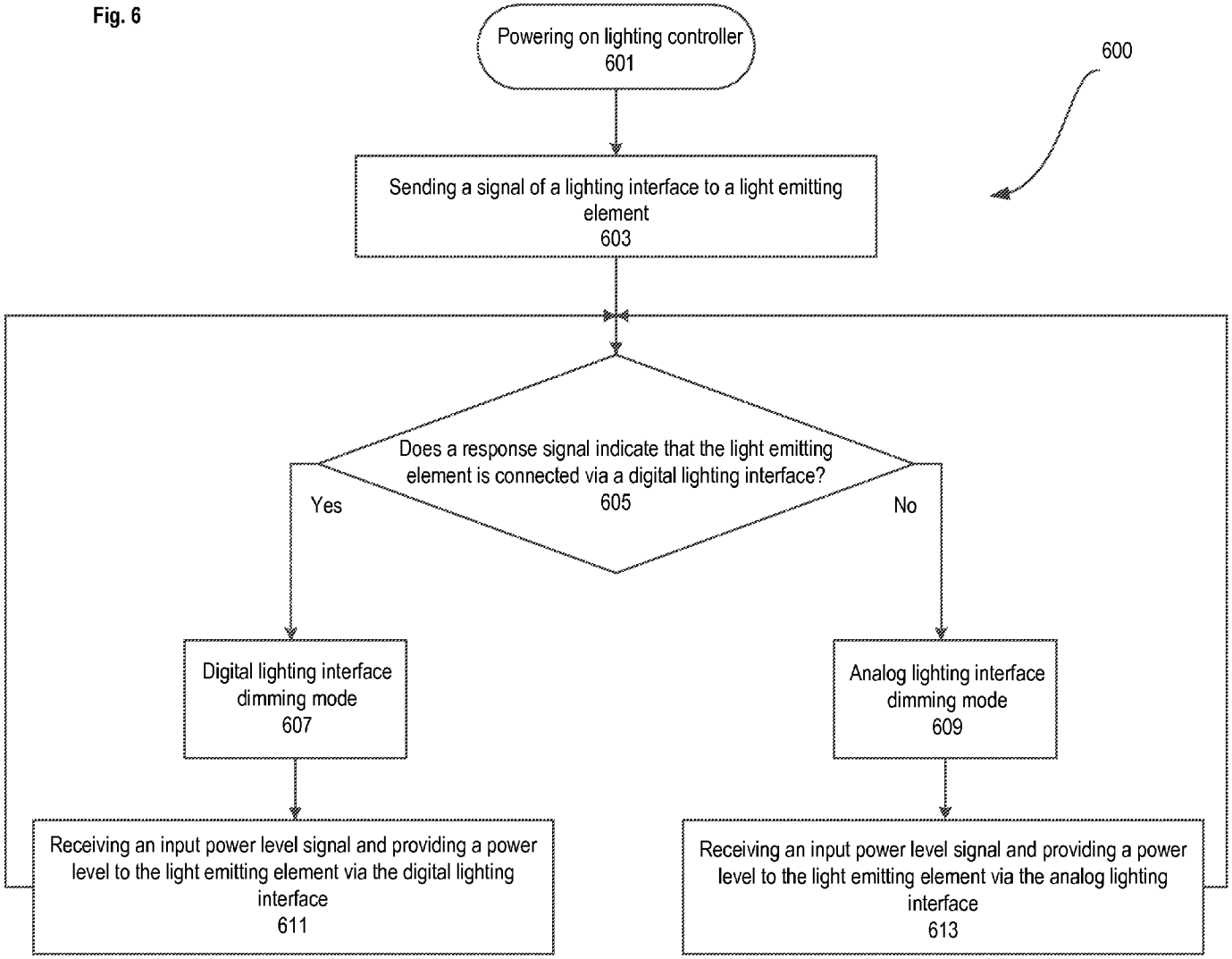
FIG. 6 is a flow diagram of an exemplary method of detecting a lighting interface and supplying the dimming signal for a light emitting element according to an embodiment of the invention.

FIG. 6 is a flow diagram illustrating an exemplary method 600 of detecting a lighting interface and supplying the appropriate power level (e.g., dimming signal) for a light emitting element, with respect to the embodiment in FIG. 3. At 601, a lighting controller (e.g., lighting controller 300) is powered on, (e.g., through a connection to a light emitting element, a signal from a processor or control logic, etc.). At 603, the lighting controller sends a signal of the lighting interface, for example an initialization signal, to a light emitting element (e.g., light emitting element 331). An initialization signal may establish communication between the lighting controller and the controlled light emitting element. A light emitting element may send a response signal to the lighting controller, e.g., indicating to the lighting controller the appropriate lighting interface for dimming control or indicating that communication therebetween has been established. Each light emitting element of a plurality utilized may send an individual response signal to the lighting controller, such as a voltage level indicating its appropriate lighting interface (e.g., a response signal of 18V indicating a digital lighting interface). In one embodiment, a response signal received from the lighting emitting element within a digital lighting interface may indicate that the lighting controller may act as a master (e.g., within a digitally addressable lighting interface) and engage the driving circuit and/or the light emitting element as a slave to provide and/or control dimming signals to the light emitting element. After sending the signal, the lighting controller may wait a period of time to receive a response (e.g., a period of 10 seconds).

At 605, the lighting controller may detect the voltage level between the input of a driving circuit (e.g., driving circuit 317) and ground. If the signal detected by the lighting controller from the driving circuit is a high-voltage signal (e.g., a voltage level between 19V and 23V), at 607, the digital lighting interface at (e.g., DALI® dimming mode) is enabled and a relay (e.g., relay 307) accepts the input signal and routes the signal through the portion of the lighting controller that is the digital lighting interface (e.g., DALI® dimming mode). In one embodiment, where the lighting controller routes an input signal through a digital lighting interface (e.g., DALI® mode), the output of the lighting controller will provide the appropriate digital lighting interface dimming signals to the light emitting element. At 611, the lighting controller may receive information (e.g., an input power level signal) from the sensing module, a processor, or other control logic including, for example, a new voltage or current level of the light emitting element or a control signal for a new lighting interface, and may provide an appropriate power level to the digital lighting interface (e.g., DALI® lighting interface) for a light emitting element. In one embodiment, the lighting controller may compare the received information to the previously detected information (e.g., a detected voltage level used to determine a previous lighting interface) and may or may not update to a new lighting interface (e.g., changing the state of the relay) based on the received information.

If the signal detected by the lighting controller from the driving circuit is not a high-voltage signal (e.g., a voltage level between 0V and 10V) at 609, this may indicate to the lighting controller that the lighting interface is not a digital lighting interface and is instead an analog lighting interface (e.g., a 0-10V dimming interface or PWM dimming interface). In such an embodiment, the input signal of the lighting controller may be an analog (e.g., 0-10V signal or PWM signal) and the relay routes the signal through the portion of the lighting controller that is the analog lighting interface (e.g., 0-10V lighting interface or PWM lighting interface). The input signal may then be routed to a PWM to 0-10V converter (e.g., PWM to 0-10V converter 313) to demodulate the input signal into an analog output signal appropriate for an analog lighting interface (e.g., the 0-10V lighting interface) and to provide an analog lighting interface dimming signal to the light emitting element. In one embodiment, the lighting controller may accept a pulse-width modulated input signal and not route the input signal through the PWM to 0-10V converter, providing a pulse-width modulated output signal appropriate for a PWM lighting interface.

At 613, the lighting controller may receive information (e.g., an input power level signal) from the sensing module, a processor, or other control logic including, for example, a new voltage or current level of the light emitting element or a control signal for a new lighting interface, and may provide an appropriate power level to the analog lighting interface (e.g., 0-10V lighting interface or PWM lighting interface) for a light emitting element. In one embodiment, the lighting controller may compare the received information to the previously detected information (e.g., a detected voltage level used to determine a previous lighting interface) and may or may not update to a new lighting interface (e.g., changing the state of the relay) based on the received information.

Certain embodiments of a lighting controller according to this disclosure may solve many lighting problems with, for example, with a single lighting controller for multiple lighting interfaces, e.g., for individual lighting fixtures. Additionally, certain embodiments according to this disclosure may allow for the installation of lighting fixtures through one set of connectors with a lighting controller to support any number of lighting functions (e.g., dimming). Certain of these features may expand lighting options, enhance sales, expand lighting solutions, and reduce the complexity of product design, production costs, and installation time and effort. Certain features of the disclosed lighting controller may allow for reduction in lighting maintenance costs and may extend the life of lighting controllers. Certain embodiments according to this disclosure may achieve improvements through the (e.g., automatic) detection of lighting interfaces and the provision of the appropriate dimming signals through hardware and/or software. For example, electricians and/or installers may simply connect two wires for a dimming system and the lighting controller, according to the disclosed embodiments, may sense the lighting interface and (e.g., automatically, with no input from an individual) configure itself with the correct lighting interface (e.g., software thereof) to operate the lighting fixture. In one embodiment, a hardware apparatus includes a sensing module to detect a lighting interface from a plurality of lighting interfaces to power a light emitting element, and a dimming module to supply multiple power levels of the lighting interface to the light emitting element. The sensing module in the hardware apparatus may detect that the lighting interface is a digital lighting interface of the plurality of lighting interfaces that includes an analog lighting interface. The sensing module in the hardware apparatus may detect that the lighting interface is an analog lighting interface of the plurality of lighting interfaces that includes a digital lighting interface. The sensing module in the hardware apparatus may detect the lighting interface from receipt of a response signal from the light emitting element. The sensing module in the hardware apparatus may detect the lighting interface from no receipt of a response signal from the light emitting element in a time period. The dimming module in the hardware apparatus may include a circuit to provide the multiple power levels from either of an analog lighting interface power supply and a digital lighting interface power supply. A communication module in the hardware apparatus may provide a signal from a network to the sensing module to detect the lighting interface.

In another embodiment, a method includes detecting a lighting interface with a sensing module from a plurality of lighting interfaces to power a light emitting element, and supplying multiple power levels of the lighting interface to the light emitting element with a dimming module. The detecting may include detecting the lighting interface is a digital lighting interface of the plurality of lighting interfaces that includes an analog lighting interface. The detecting may include detecting the lighting interface is an analog lighting interface of the plurality of lighting interfaces that includes a digital lighting interface. The detecting may include detecting the lighting interface from receipt of a response signal from the light emitting element. The detecting may include detecting the lighting interface from no receipt of a response signal from the light emitting element. The supplying may include supplying the multiple power levels from either of an analog lighting interface power supply and a digital lighting interface power supply. The method may include providing with a communication module a signal from a network to the sensing module to detect the lighting interface.

In one embodiment, an apparatus includes a set of one or more processors and a set of one or more data storage devices that stores code, that when executed by the set of processors causes the set of one or more processors to: detect a lighting interface with a sensing module from a plurality of lighting interfaces to power a light emitting element and supply multiple power levels of the lighting interface to the light emitting element with a dimming module. The set of data storage devices may further store code, that when executed by the set of processors causes the set of processors to perform the following: detecting the lighting interface is a digital lighting interface of the plurality of lighting interfaces that includes an analog lighting interface. The set of data storage devices may further store code, that when executed by the set of processors causes the set of processors to perform the following: detecting the lighting interface is an analog lighting interface of the plurality of lighting interfaces that includes a digital lighting interface. The set of data storage devices may further store code, that when executed by the set of processors causes the set of processors to perform the following: detecting the lighting interface from receipt of a response signal from the light emitting element. The set of data storage devices may further store code, that when executed by the set of processors causes the set of processors to perform the following: detecting the lighting interface from no receipt of a response signal from the light emitting element. The set of data storage devices may further store code, that when executed by the set of processors causes the set of processors to perform the following: supplying the multiple power levels from either of an analog lighting interface power supply and a digital lighting interface power supply. The set of data storage devices may further store code, that when executed by the set of processors causes the set of processors to perform the following: providing with a communication module a signal from a network to the sensing module to detect the lighting interface.

What is claimed is:

1. A hardware apparatus comprising:

a sensing module to detect a lighting interface from a plurality of lighting interfaces to power a light emitting element based upon a response from a transmission of a signal to the light emitting; and a dimming module to supply multiple power levels of the lighting interface to the light emitting element.

2. The hardware apparatus of claim 1, wherein the sensing module is to detect the lighting interface is a digital lighting interface of the plurality of lighting interfaces that includes an analog lighting interface.

3. The hardware apparatus of claim 1, wherein the sensing module is to detect the lighting interface is an analog lighting interface of the plurality of lighting interfaces that includes a digital lighting interface.

4. The hardware apparatus of claim 1, wherein the sensing module is to detect the lighting interface from receipt of a response signal from the light emitting element.

5. The hardware apparatus of claim 1, wherein the sensing module is to detect the lighting interface from no receipt of a response signal from the light emitting element in a time period.

6. The hardware apparatus of claim 1, wherein the dimming module comprises a circuit to provide the multiple power levels from either of an analog lighting interface power supply and a digital lighting interface power supply.

7. The hardware apparatus of claim 1, further comprising a communication module to provide a signal from a network to the sensing module to detect the lighting interface.

8. A method comprising:

detecting a lighting interface with a sensing module from a plurality of lighting interfaces to power a light emitting element based upon a response from a transmission of a signal to the light emitting; and supplying multiple power levels of the lighting interface to the light emitting element with a dimming module.

9. The method of claim 8, wherein the detecting comprises detecting the lighting interface is a digital lighting interface of the plurality of lighting interfaces that includes an analog lighting interface.

10. The method of claim 8, wherein the detecting comprises detecting the lighting interface is an analog lighting interface of the plurality of lighting interfaces that includes a digital lighting interface.

11. The method of claim 8, wherein the detecting comprises detecting the lighting interface from receipt of a response signal from the light emitting element.

12. The method of claim 8, wherein the detecting comprises detecting the lighting interface from no receipt of a response signal from the light emitting element.

13. The method of claim 8, wherein the supplying comprises supplying the multiple power levels from either of an analog lighting interface power supply and a digital lighting interface power supply.

14. The method of claim 8, further comprising providing with a communication module a signal from a network to the sensing module to detect the lighting interface.

15. An apparatus comprising:

a set of one or more processors; and a set of one or more data storage devices that stores code, that when executed by the set of processors causes the set of one or more processors to perform the following:

detecting a lighting interface with a sensing module from a plurality of lighting interfaces to power a light emitting element based upon a response from a transmission of a signal to the light emitting; and supplying multiple power levels of the lighting interface to the light emitting element with a dimming module.

16. The apparatus of claim 15, wherein the set of data storage devices further stores code, that when executed by the set of processors causes the set of processors to perform the following:

wherein the detecting comprises detecting the lighting interface is a digital lighting interface of the plurality of lighting interfaces that includes an analog lighting interface.

17. The apparatus of claim 15, wherein the set of data storage devices further stores code, that when executed by the set of processors causes the set of processors to perform the following:

wherein the detecting comprises detecting the lighting interface is an analog lighting interface of the plurality of lighting interfaces that includes a digital lighting interface.

18. The apparatus of claim 15, wherein the set of data storage devices further stores code, that when executed by the set of processors causes the set of processors to perform the following:

wherein the detecting comprises detecting the lighting interface from receipt of a response signal from the light emitting element.

19. The apparatus of claim 15, wherein the set of data storage devices further stores code, that when executed by the set of processors causes the set of processors to perform the following:

wherein the detecting comprises detecting the lighting interface from no receipt of a response signal from the light emitting element.

20. The apparatus of claim 15, wherein the set of data storage devices further stores code, that when executed by the set of processors causes the set of processors to perform the following:

wherein the supplying comprises supplying the multiple power levels from either of an analog lighting interface power supply and a digital lighting interface power supply.

21. The apparatus of claim 15, wherein the set of data storage devices further stores code, that when executed by the set of processors causes the set of processors to perform the following:

further comprising providing with a communication module a signal from a network to the sensing module to detect the lighting interface.

* * * * *